US007155749B1

(12) United States Patent
Gelbart et al.

(10) Patent No.: US 7,155,749 B1
(45) Date of Patent: Jan. 2, 2007

(54) TOILET SEAT COVER DISPENSER SYSTEM

(76) Inventors: Ida Gelbart, 129 Meadowcreek Dr., Corte Madera, CA (US) 94925-1281; Mark E. Goldman, 309 Riviera Dr., San Rafael, CA (US) 94901-1528

( * ) Notice: Subject to any disclaimer, the term of this patent is extended or adjusted under 35 U.S.C. 154(b) by 319 days.

(21) Appl. No.: 10/818,523

(22) Filed: Apr. 5, 2004

(51) Int. Cl.
*A47K 13/22* (2006.01)

(52) U.S. Cl. ..... 4/244.2; 4/254.4

(58) Field of Classification Search ..... 4/244.1, 4/244.2, 245.4
See application file for complete search history.

(56) References Cited

U.S. PATENT DOCUMENTS 972,269 A * 10/1910 Slough ..... 4/245.4 X
1,163,667 A * 12/1915 Bangen ..... 4/244.2
1,307,162 A * 6/1919 Taylor ..... 4/244.2 X
1,435,685 A * 11/1922 Jiranek ..... 4/244.2

* cited by examiner

*Primary Examiner*—Robert M. Fetsuga
(74) *Attorney, Agent, or Firm*—Edward P. Dutkiewicz

(57) ABSTRACT

A cartridge has lower and upper plates, vertically oriented front, rear and side plates and a rotatable cylindrical core supported adjacent to its ends between the side plates. A roll of paper constitutes covers attached to the core. A free end extends through the opening and terminates at a forward end of a seat. The paper is comprised of consecutive lengths separated by transverse perforations with a tab centrally located and forwardly extending. Each length has a lower surface with an adhesive.

2 Claims, 3 Drawing Sheets

FIG 1
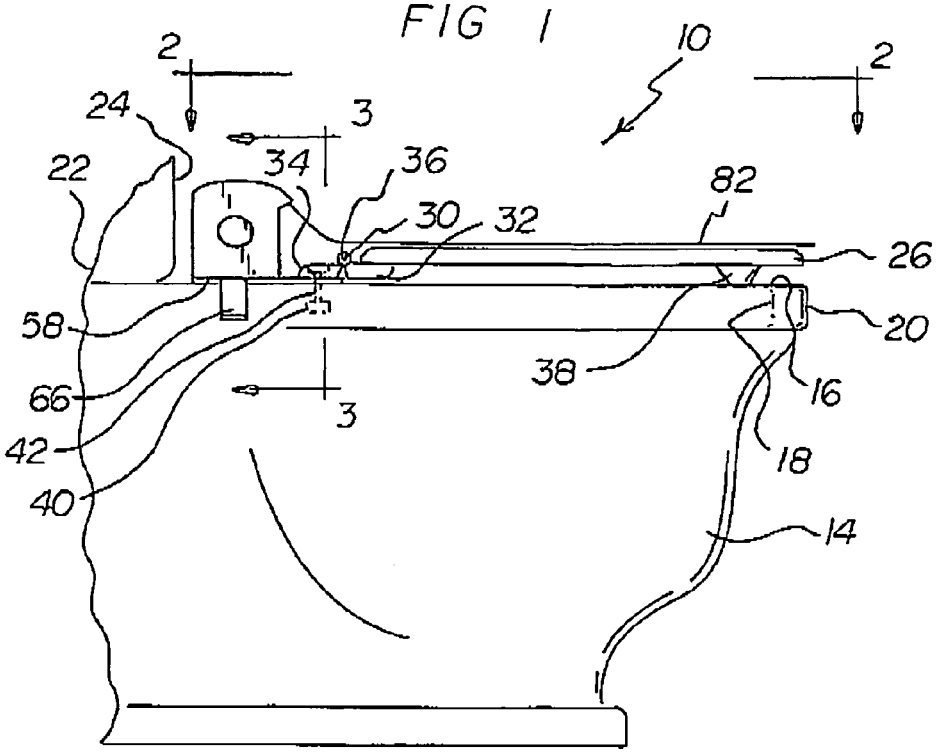
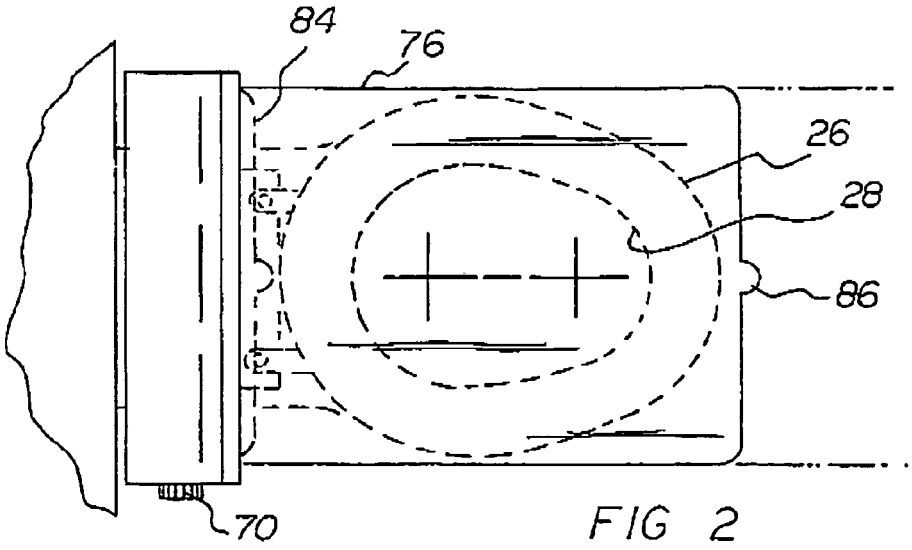
FIG 2

TOILET SEAT COVER DISPENSER SYSTEM

BACKGROUND OF THE INVENTION

1. Field of the Invention

The present invention relates to a toilet seat cover dispenser system and more particularly pertains to adhesively adhering a cover to a toilet seat for each individual use in a manner which is sanitary and convenient.

2. Description of the Prior Art

The use of dispensers of known designs and configurations is known in the prior art. More specifically, dispensers of known designs and configurations previously devised and utilized for the purpose of providing sanitary toilet seats through known designs and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,186,439 issued Feb. 13, 2001 to Carey relates to a rolled product dispenser assembly. U.S. Pat. No. 4,935,967 issued Jun. 26, 1990 to Cour relates to an automated toilet seat cover apparatus. Lastly, U.S. Pat. No. 4,887,321 issued Dec. 19, 1989 to MacLean relates to a sanitary toilet seat cover.

While these devices fulfill their respective, particular objectives and requirements, the aforementioned patents do not describe toilet seat cover dispenser system that allows adhesively adhering a cover to a toilet seat for each individual use in a manner which is sanitary and convenient.

In this respect, the toilet seat cover dispenser system according to the present invention substantially departs from the conventional concepts and designs of the prior art, and in doing so provides an apparatus primarily developed for the purpose of adhesively adhering a cover to a toilet seat for each individual use in a manner which is sanitary and convenient.

Therefore, it can be appreciated that there exists a continuing need for a new and improved toilet seat cover dispenser system which can be used for adhesively adhering a cover to a toilet seat for each individual use in a manner which is sanitary and convenient. In this regard, the present invention substantially fulfills this need.

SUMMARY OF THE INVENTION

In view of the foregoing disadvantages inherent in the known types of dispensers of known designs and configurations now present in the prior art, the present invention provides an improved toilet seat cover dispenser system. As such, the general purpose of the present invention, which will be described subsequently in greater detail, is to provide a new and improved toilet seat cover dispenser system and method which has all the advantages of the prior art and none of the disadvantages.

To attain this, the present invention essentially comprises a toilet. The toilet seat has a fixedly positioned bowl. The bowl has a horizontal upper face with an opening. The opening is in a generally oval configuration. The toilet and upper face have a free front and a rear with an upwardly extending tank.

A seat assembly is provided. The seat has a generally oval seat. The seat has an upper surface and a lower surface. An opening is provided between the upper and lower surfaces. The seat is positionable above the opening of the toilet. A hinge is provided. The hinge has two laterally spaced forward hinge plates. The hinge plates have upper surfaces. The upper surfaces are secured to the seat adjacent to the rear of the upper face of the bowl forwardly of the tank. The hinge has rearward hinge plates. The rearward hinge plates are coupled to the rear of the upper face of the bowl between the forward hinge plates and the tank. The hinge also has a hinge rod. The hinge rod pivotably couples the forward hinge plates and the rearward hinge plates. In this manner a user is allowed to rotate the forward hinge plates and seat between a raised orientation and a lowered orientation. In the raised orientation the seat is generally perpendicular to the upper face of the bowl. In the lowered orientation the seat is generally parallel with the upper face of the bowl. Elastomeric pads are provided. The elastomeric pads are attached to the lower surface of the seat adjacent to the front for cushioning purposes. The seat assembly also includes two bolts. The bolts have associated nuts. The bolts removably couple the rearward hinge plates to the upper face of the bowl.

Further provided is a cartridge. The cartridge is in a generally rectilinear configuration. The cartridge has a lower horizontal plate and an upper plate. Vertically oriented front and rear plates are provided between the lower and upper plates. Side plates are laterally spaced a distance greater than the width of the seat. The cartridge includes an under plate 58. The upper plate has a rearward extent. The rearward extent is secured the lower surface of the lower plate of the cartridge. The upper plate has a forward extent. The forward extent is positioned between the rear hinge plate and the upper face of the bowl. Apertures are provided. The apertures receive the bolts. The under plate includes laterally spaced resilient fingers. The fingers grasp the bowl to removably couple the cartridge to the bowl. The fingers are located over the upper face of the bowl between the hinge and the tank. The cartridge also includes a rotatable cylindrical core. A thumb wheel is provided. The thumb wheel supports the core adjacent to its ends between the side plates. The core is secured to the core exterior of the side walls. In this manner a user may selectively rotate the core. The cartridge also includes a downwardly facing opening. The opening is formed between the front plate and the upper plate.

Provided last is a roll. The roll is fabricated of thin tissue-like paper. The role has a cover. The roll has an interior end. The interior end is attached to the core. The roll has a free end. The free end extends through the opening and terminates at the forward end of the seat. The paper is comprised of consecutive lengths. The lengths are separated by transverse perforations. A centrally located, forwardly extending tab is provided. The tab is adapted to be held by a user for pulling the next sequential length. Each length has a lower surface. The lower surface has an adhesive. Each length has an upper surface. The upper surface is without an adhesive. In this manner one length is allowed to temporarily adhere to the upper surface of the seat during use and then be peeled from the seat after one use and flushed away from the bowl. Each length has two longitudinally spaced, cross-shaped slits. The slits are provided over the opening of the bowl. In this manner an opening is formed to allow passage of matter through the cover, seat and opening of the bowl.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this: respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet seat cover dispenser system which has all of the advantages of the prior art dispensers of known designs and configurations and none of the disadvantages.

It is another object of the present invention to provide a new and improved toilet seat cover dispenser system which may be easily and efficiently manufactured and marketed.

It is further object of the present invention to provide a new and improved toilet seat cover dispenser system which is of durable and reliable constructions.

An even further object of the present invention is to provide a new and improved toilet seat cover dispenser system which is susceptible of a low cost of manufacture with regard to both materials and labor, and which accordingly is then susceptible of low prices of sale to the consuming public, thereby making such toilet seat cover dispenser system economically available to the buying public.

Even still another object of the present invention is to provide a toilet seat cover dispenser system for adhesively adhering a cover to a toilet seat for each individual use in a manner which is sanitary and convenient.

Lastly, it is an object of the present invention to provide a new and improved toilet seat cover dispenser system. A cartridge has a lower and upper plate, vertically oriented front and rear plates and side plates. The cartridge also includes a rotatable cylindrical core. The core is supported adjacent to its ends between the side plates. A roll of paper constitutes covers attached to the core. A free end extends through the opening and terminates at a forward end of a seat. The paper is comprised of consecutive lengths. The lengths are separated by transverse perforations. A centrally located, forwardly extending tab is provided. Each length has a lower surface with an adhesive.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a toilet seat cover dispenser system constructed in accordance with the principles of the present invention.

FIG. 2 is a plan view of the system taken along line 2—2 of FIG. 1.

The same reference numerals refer to the same parts throughout the various Figures.

DESCRIPTION OF THE PREFERRED EMBODIMENT

Figure 3:
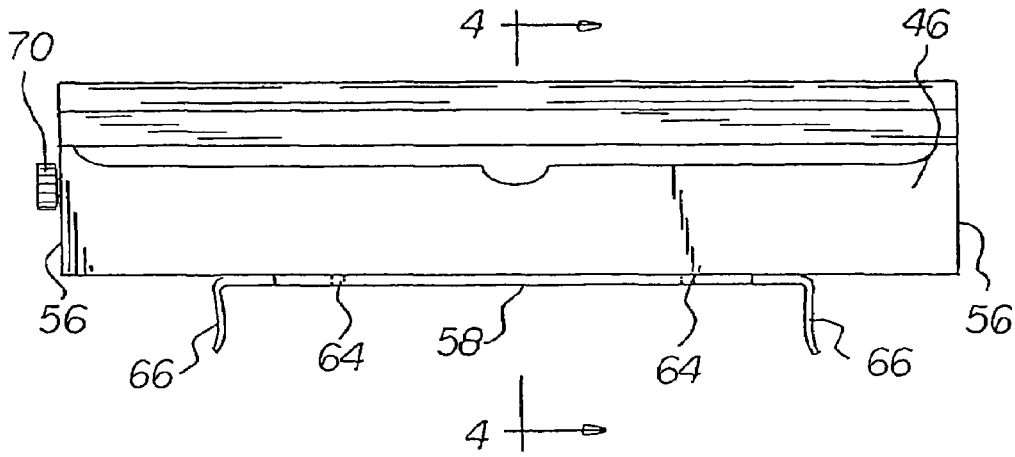
FIG. 3 is a cross sectional view taken along line 3—3 of FIG. 1.
Figure 4:
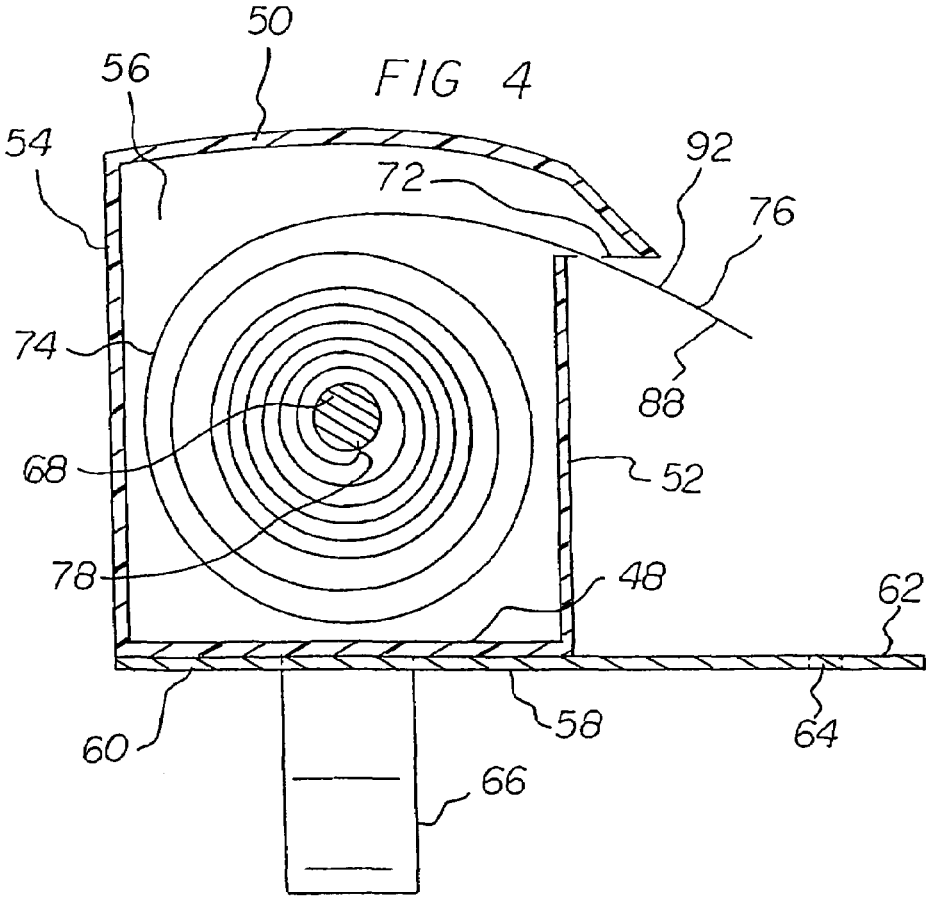
FIG. 4 is a cross sectional view taken along line 4—4 of FIG. 3.
Figure 5:
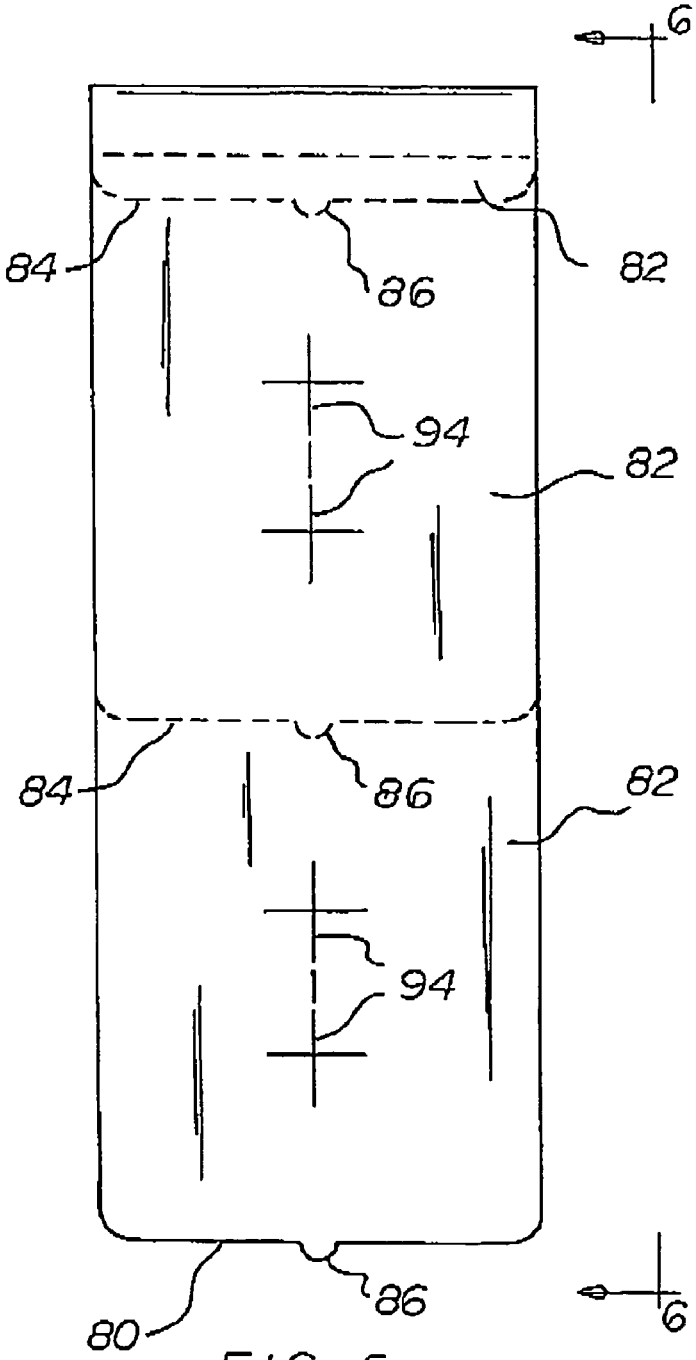
FIG. 5 is a plan view of two lengths of the seat cover and the cartridge shown in the prior Figures.
Figure 6:
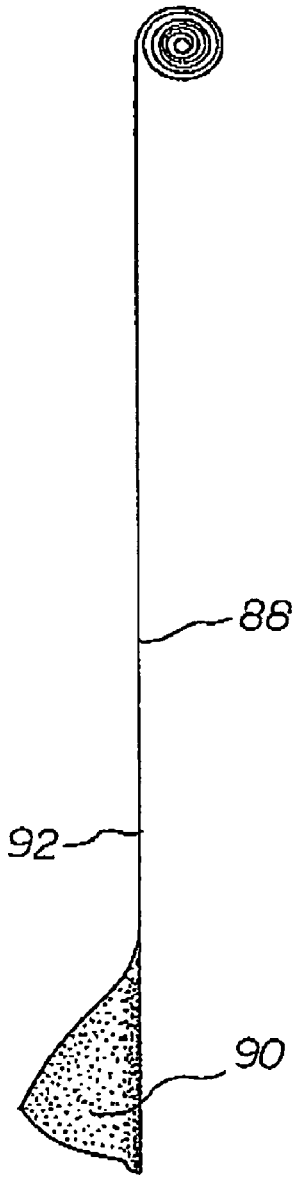
FIG. 6 is a side elevational view taken along line 6—6 of FIG. 5 but with one corner tipped up.

With reference now to the drawings, and in particular to FIG. 1 thereof, the preferred embodiment of the new and improved toilet seat cover dispenser system embodying the principles and concepts of the present invention and generally designated by the reference numeral 10 will be described.

The present invention, the toilet seat cover dispenser system 10 is comprised of a plurality of components. Such components in their broadest context include a cartridge and a roll of paper. Such components are individually configured and correlated with respect to each other so as to attain the desired objective.

First provided is a toilet. The toilet seat has a fixedly positioned bowl 14. The bowl has a horizontal upper face 16 with an opening 18. The opening is in a generally oval configuration. The toilet and upper face have a free front 20 and a rear 22 with an upwardly extending tank 24.

A seat assembly is provided. The seat has a generally oval seat 26. The seat has an upper surface and a lower surface. An opening 28 is provided between the upper and lower surfaces. The seat is positionable above the opening of the toilet. A hinge 30 is provided. The hinge has two laterally spaced forward hinge plates 32. The hinge plates have upper surfaces. The upper surfaces are secured to the seat adjacent to the rear of the upper face of the bowl forwardly of the tank. The hinge has rearward hinge plates 34. The rearward hinge plates are coupled to the rear of the upper face of the bowl between the forward hinge plates and the tank. The hinge also has a hinge rod 36. The hinge rod pivotably couples the forward hinge plates and the rearward hinge plates. In this manner a user is allowed to rotate the forward hinge plates and seat between a raised orientation and a lowered orientation. In the raised orientation the seat is generally perpendicular to the upper face of the bowl. In the lowered orientation the seat is generally parallel with the upper face of the bowl. Elastomeric pads 38 are provided. The Elastomeric pads are attached to the lower surface of the seat adjacent to the front for cushioning purposes. The seat assembly also includes two bolts 40. The bolts have associated nuts 42. The bolts removably couple the rearward hinge plates to the upper face of the bowl.

Further provided is a cartridge 46. The cartridge is in a generally rectilinear configuration. The cartridge has a lower horizontal plate 48 and an upper plate 50. Vertically oriented front and rear plates 52, 54 are provided between the lower and upper plates. Side plates 56 are laterally spaced a distance greater than the width of the seat. The cartridge includes an under plate 58. The upper plate has a rearward extent 60. The rearward extent is secured the lower surface of the lower plate of the cartridge. The upper plate has a forward extent 62. The forward extent is positioned between the rear hinge plate and the upper face of the bowl. Apertures 64 are provided. The apertures receive the bolts. The under plate includes laterally spaced resilient fingers 66. The fingers grasp the bowl to removably couple the cartridge to the bowl. The fingers are located over the upper face of the bowl between the hinge and the tank. The cartridge also includes a rotatable cylindrical core 68. A thumb wheel is provided 70. The thumb wheel supports the core adjacent to its ends between the side plates. The core is secured to the core exterior of the side walls. In this manner a user may selectively rotate the core. The cartridge also includes a downwardly facing opening 72. The opening is formed between the front plate and the upper plate.

Provided last is a roll 74. The roll is fabricated of thin tissue-like paper. The role has a cover 76. The roll has an interior end 78. The interior end is attached to the core. The roll has a free end 80. The free end extends through the opening and terminates at the forward end of the seat. The paper is comprised of consecutive lengths 82. The lengths are separated by transverse perforations 84. A centrally located, forwardly extending tab 86 is provided. The tab is adapted to be held by a user for pulling the next sequential length. Each length has a lower surface 88. The lower surface has an adhesive 90. Each length has an upper surface 92. The upper surface is without an adhesive. In this manner one length is allowed to temporarily adhere to the upper surface of the seat during use and then be peeled from the seat after one use and flushed away from the bowl. Each length has two longitudinally spaced, cross-shaped slits 94. The slits are provided over the opening of the bowl. In this manner an opening is formed to allow passage of matter through the cover, seat and opening of the bowl.

The adhesive of the present invention is preferably a pressure-sensitive adhesive of the type commercially sold as Post It tm brand sheet material with an adhesive coating on one side. Such adhesive is described in U.S. Pat. No. 4,768,810, the subject matter of which is incorporated herein by reference. Post It is a trademark of Minnesota Mining and Manufacturing Company of Minnesota.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seat cover dispenser system comprising:

a cartridge with a lower and an upper plate and with vertically oriented front and rear plates and side plates, the cartridge also including a rotatable cylindrical core supported adjacent to its ends between the side plates:

a roll of paper constituting covers attached to the core with a free end extending through the opening and terminating at a forward end, the paper being comprised of consecutive lengths separated by transverse perforations with a centrally located, forwardly extending tab, each length having a lower surface with an adhesive; and an under plate having a rearward extent secured to the cartridge and a forward extent, the rearward extent including laterally spaced resilient fingers.

2. A toilet seat cover dispenser system for adhesively adhering a cover to a toilet seat for each individual use in a manner which is sanitary and convenient comprising, in combination:

a toilet having a fixedly positioned bowl with a horizontal upper face with an opening in a generally oval configuration, the toilet and upper face having a free front and a rear with an upwardly extending tank;

a seat assembly having a generally oval seat with an upper surface and a lower surface and with an opening therebetween positionable above the opening of the toilet and a hinge, the hinge having two laterally spaced forward hinge plates with upper surfaces secured to the seat adjacent to the rear of the upper face of the bowl forwardly of the tank, the hinge having rearward hinge plates coupled to the rear of the upper face of the bowl between the forward hinge plates and the tank, the hinge also having a hinge rod pivotably coupling the forward hinge plates and the rearward hinge plates for allowing a user to rotate the forward hinge plates and seat between a raised orientation generally perpendicular to the upper face of the bowl and a lowered orientation generally parallel with the upper face of the bowl and with elastomeric pads attached to the lower surface of the seat adjacent to the front for cushioning purposes, the seat assembly also including two bolts with associated nuts removably coupling the rearward hinge plates to the upper face of the bowl;

a cartridge in a generally rectilinear configuration with a lower horizontal plate and with an upper plate and with vertically oriented front and rear plates and side plates laterally spaced a distance greater than the width of the seat, the cartridge including an under plate having a rearward extent secured the lower surface of the lower plate of the cartridge and a forward extent positioned between the rear hinge plate and the upper face of the bowl with apertures receiving the bolts, the under plate including laterally spaced resilient fingers for grasping the bowl to removably couple the cartridge to the bowl, the fingers being located over the upper face of the bowl between the hinge and the tank, the cartridge also including a rotatable cylindrical core supported adjacent to its ends between the side plates with a thumb wheel secured to the core exterior of the side walls to allow a user to selectively rotate the core, the cartridge also including a downwardly facing opening formed between the front plate and the upper plate; and a roll fabricated of thin tissue-like paper constituting a cover with an interior end attached to the core and a free end extending through the opening and terminating at the forward end of the seat, the paper being comprised of consecutive lengths separated by transverse perforations with a centrally located, forwardly extending tab adapted to be held by a user for pulling the next sequential length, each length having a lower surface with an adhesive and an upper surface without an adhesive to allow one length to temporarily adhere to the upper surface of the seat during use and then to be peeled from the seat after one use and flushed away from the bowl, each length having two longitudinally spaced, cross-shaped slits over the opening of the bowl for forming an opening to allow passage of matter through the cover, seat and opening of the bowl.

* * * * *